US005971485A

United States Patent [19]

Clark

[11] Patent Number: 5,971,485

[45] Date of Patent: Oct. 26, 1999

[54] ADJUSTABLE, FOLDING CHAIR FOR MASSAGE

[76] Inventor: Roland Clark, 22052 Islander La., Huntington Beach, Calif. 92646

[21] Appl. No.: 08/865,881

[22] Filed: May 30, 1997

[51] Int. Cl.[6] ..... A47C 7/50

[52] U.S. Cl. ..... 297/423.12; 297/423.11; 297/338; 297/195.11; 297/344.18; 297/408; 297/215.13

[58] Field of Search ..... 297/423.12, 423.11, 297/337, 338, 195.11, 215.13, 411.31, 411.32, 411.36, 411.38, 408, 391

[56] References Cited

U.S. PATENT DOCUMENTS

| | | | |
|---|---|---|---|
| 3,754,787 | 8/1973 | Garber | 297/423.38 X |
| 3,894,601 | 7/1975 | Gestring | 297/344.18 X |
| 4,650,249 | 3/1987 | Serber | 297/423.11 |
| 4,662,361 | 5/1987 | Patterson | 297/195.11 |
| 4,746,167 | 5/1988 | Palmer et al. | 297/423.12 |
| 5,177,823 | 1/1993 | Rioch | 297/408 X |
| 5,330,254 | 7/1994 | Larson | 297/338 X |
| 5,401,078 | 3/1995 | Riach | 297/423.11 |
| 5,487,590 | 1/1996 | Haynes | 297/338 X |
| 5,490,716 | 2/1996 | Naughton | 297/423.12 |

*Primary Examiner*—Peter M. Cuomo
*Assistant Examiner*—Rodney B. White
*Attorney, Agent, or Firm*—Gene Scott-Patent Law & Venture Group

[57] ABSTRACT

An adjustable and foldable chair for massaging an individual provides a pair of upwardly directed support struts pivotally joined by a leg support strut and is able to stand erect on a pair of laterally disposed feet at the ends of the support struts. A buttock, leg, chest, arm and face supports are positionally adjustable. The support struts are convergent with the included angle being adjustable over a range of approximately 47 degrees. This range of adjustability allows the chair to accept the body conformations of children, women and men of all sizes.

10 Claims, 5 Drawing Sheets

FIG. 2b
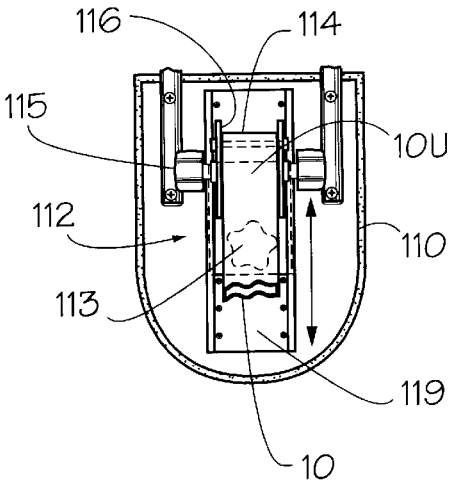
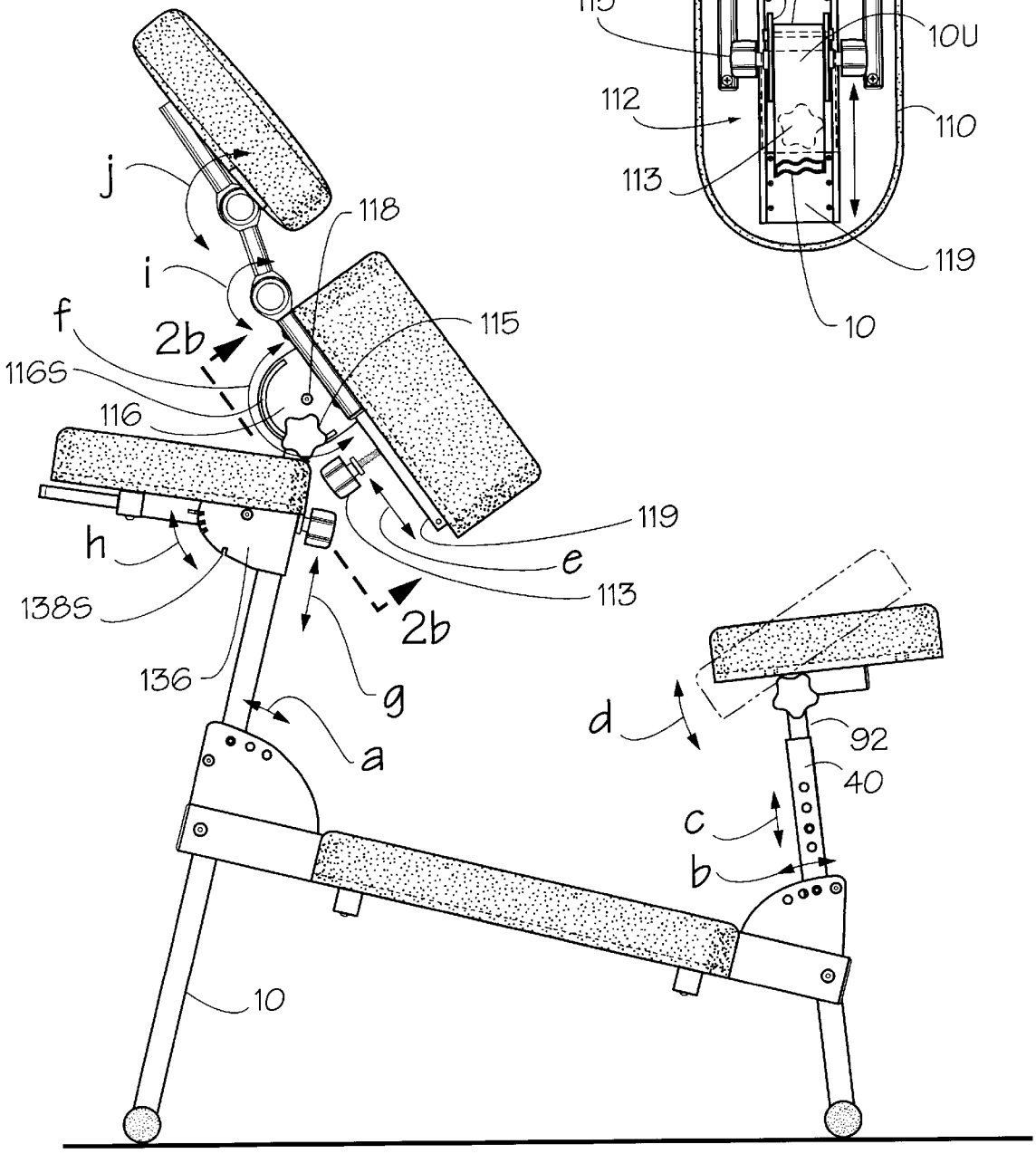
FIG. 2a

ADJUSTABLE, FOLDING CHAIR FOR MASSAGE

BACKGROUND OF THE INVENTION

1. Field of the Invention

This invention relates generally to massage chairs, and more particularly to an adjustable, folding massage chair having a pair of adjustably converging support struts; one of the struts supporting a seat, the other supporting an arm, chest an face pads.

2. Description of Related Art

The following art defines the present state of this field:

Serber, U.S. Pat. No. 4,650,249 describes an ergonomic seating assembly system with front chest support components, pelvic tilt seat component, and related attachments. The invention comprises an ergonomic support system for a person in a seated position comprised of a torso support platform, a seat, and a shin support platform. All are supported by a main frame generally the size of a common chair. Related attachments for face and arm support and pelvic tilt allow alignment of the body and unimpeded movement of the arms and pelvis and a healthy and comfortable position of the spine. It is clear that Server teaches the general principle and advantages of a forward leaning sitting position with chest, face and legs fully supported. However, Serber fails to teach that it is possible to use a combination leg support that is also the structural element joining the seat and chest support struts.

Patterson, U.S. Pat. No. 4,662,361 describes an elongated base that includes front and rear ends and the rear end includes an elevated seat portion. The forward end of the base includes a standard projecting upwardly to a level above the seat and a rearwardly and upwardly inclined support arm is mounted from the upper end of the standard. The rear upper end of the support arm includes a rearwardly facing chest pad in general vertical registry with and spaced above the forward marginal edge of the seat. The support arm is mounted from the standard for forward and upward swinging of the rear end of the support arm from a lower limit position. The support arm additionally supports a head (forehead) rest supported at an elevation above the chest pad and mounted from the support arm for front to rear adjustment relative to the chest pad. Patterson fails to teach arm and leg rests, seat elevational adjustment, and adaptability for individuals with small as well as large frames.

Riach, U.S. Pat. No. 5,401,078 describes a unitary, portable, foldable and adjustable therapy chair on which a patient is seated. The chair includes a frame having two pivotal members, which move in a scissors-like manner. Attached to the frame are a seat, a chest support, an arm support, a face support and a pair of leg supports. The chair is adjustable from a collapsed position to a plurality of erect position. The frame may be secured in a desired use position. When the chair is adjusted, the seat, the chest support, the arm support and the leg supports move with respect to one another. Riach provides separate masts for seat, chest/arms/head, and leg supports. These are configured primarily for compact folding but do not exhibit the range of adjustability considered necessary for a wide range of body conformations.

Haynes, U.S. Pat. No. 5,487,590 describes a chair to promulgate kinesthetic therapy that includes a seat frame, a chest rest frame, an arm rest frame and a base. The seat frame and the chest rest frame are moveable independently upwardly and inwardly from the base where they support a seat and chest rest respectively. Both the seat and headrest are adjustable along the same axis via frames. A wide range of adjustability is provided with Haynes, however, the seat and chest masts are not angularly adjustable so as to provide improved adaptability of the Haynes chair to a wider range of body sizes.

The prior art teaches massages chairs as described in the abstracts above. However, the prior art does not teach that a light-weight portable chair structure is able to provide a wide range of body size accommodation through the use of adjustment in the angle of convergence of the seat and the chest masts as well as appropriately coordinated elevational and angular adjustments in the several rest means, i.e., seat, arms, chest, and face. The present invention fulfills these needs and provides further related advantages as described in the following summary.

SUMMARY OF THE INVENTION

The present invention teaches certain benefits in construction and use, which give rise to the objectives described below.

The present invention provides a lightweight, rugged, highly adjustable and compactly foldable chair for massaging an individual. The chair includes a pair of upwardly directed support struts pivotally joined by a leg support strut and able to stand erect on a pair of laterally disposed feet at the ends of the support struts. A buttock, chest, arm and face supporting pads are each positionally adjustable. The support struts are convergent with the included angle being adjustable over a range of approximately 47 degrees. This range of adjustability allows the chair to accept the body conformations of children, women and men of all sizes. The critical discovery in the present invention is that it is necessary to provide elevational as well as angular adjustment of each of the major body support elements provided in the invention, in conjunction with the ability to change the angle of convergence of the two main upwardly extending support masts. By changing the angle formed by the apex between the upwardly extending support masts it is possible to change the overall accommodation size of the chair so as to accept large men as well as small children. However, this extreme adjustment parameter must be coordinated with changes in elevation and angle of the major support elements. Both of these types of adjustments must work together in order to gain the maximum use of a single massage chair for the widest range of body conformations and sizes.

A primary objective of the present invention is to provide a massage chair having advantages in weight, strength and adjustability not taught by the prior art.

Another objective is to provide such a chair having a pair of support struts disposed at a convergent angle, wherein the angle is adjustable over a range of approximately 47 degrees so as to enable the positioning of the chest, arm and face rest pads with respect to the seat for accepting a range of body sizes from pre-adolescent to large male adult.

A further objective is to provide such a chair having relatively few struts and other components and made of a lightweight material and formed of hollow structural shapes so as to be lighter, yet stronger than chairs for similar use known to the prior art.

An important further objective is to provide such a chair having elevational as well as angular adjustment in seat, chest, face and arm supports, wherein these adjustments are coordinated with the ability to change the convergent angle of the supporting masts that carry the body part supports.

A final and important objective of the present invention is to provide such a chair having the ability to be folded compactly for portability or storage.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 2*a* is a side elevational view thereof showing the adjustments possible with the important structural elements of the invention;

FIG. 2*b* is an elevational view taken along line 2*b*—2*b* of FIG. 2*a* and particularly showing certain mounting features of a chest rest of the invention;

DETAILED DESCRIPTION OF THE INVENTION

Figure 1:
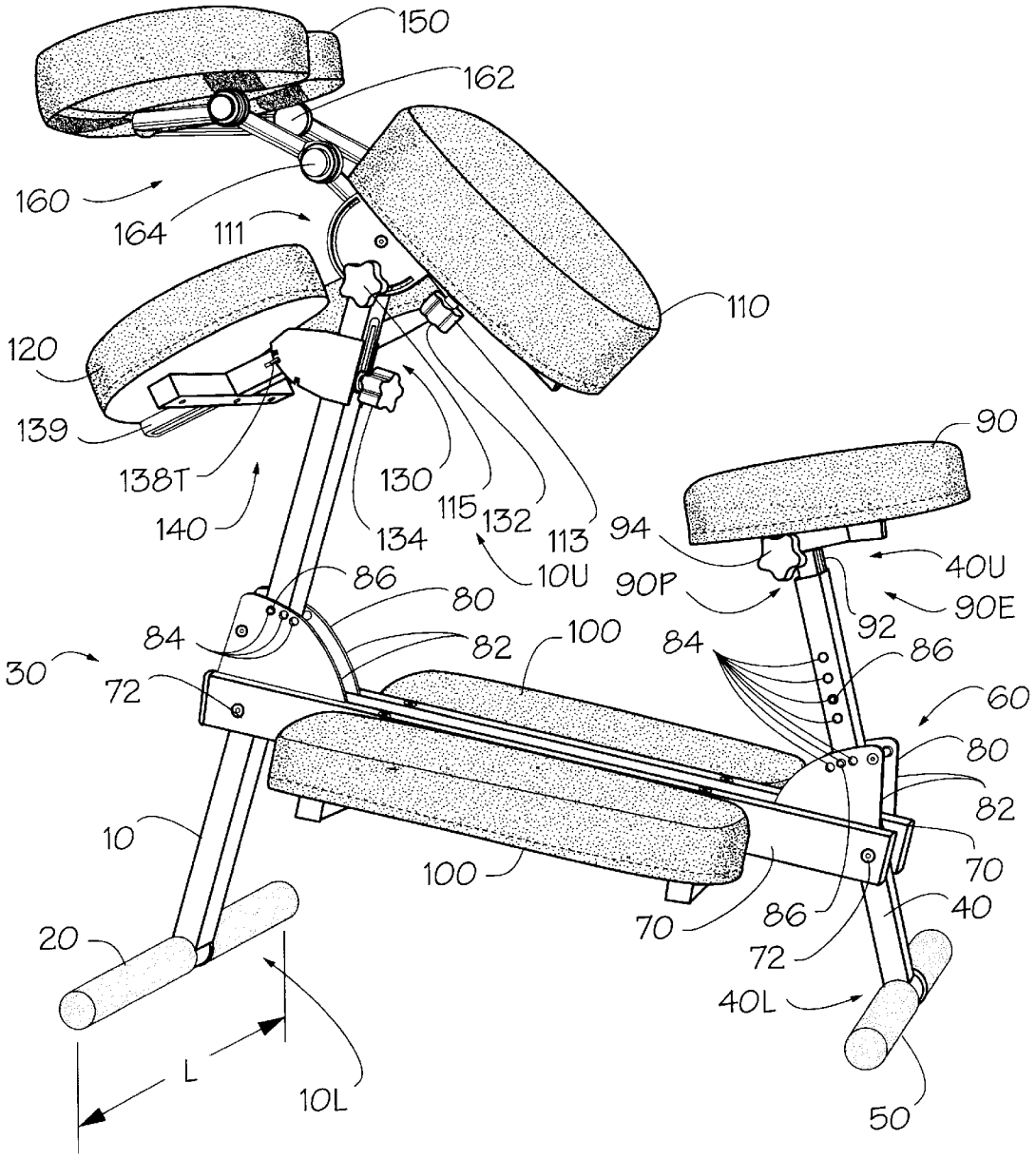
FIG. 1 is a perspective view of the preferred embodiment of the present invention shown in a fully unfolded state ready for receiving an individual for massage.

The above described drawing figures illustrate the invention, a chair apparatus for massaging an individual. As shown in FIG. 1 a forward support strut 10 is positioned in a generally upright attitude. It provides a laterally disposed forward support foot 20 engaged at a lower end 10L of the strut 10 however, other types of support feet or mechanisms might be used to support the apparatus successfully. The forward strut 10 defines a forward end 30 of the apparatus. Likewise, a rearward support strut 40 is also positioned in a generally upright attitude. It also provides a laterally disposed rearward support foot 50 which, is engaged at a lower end 40L of the rearward strut 40. The rearward strut 40 defines a rearward end 60 of the apparatus. The struts 10 and 40 are preferably made of a structural square or rectangular tubing of a light structural material such as aluminum, and the feet 20 and 50 are preferably permanently attached, as by welding or the like, to the struts 10 and 40 respectively. The feet 20 and 50 are preferably oriented laterally in the apparatus and are of sufficient length "L" to provide stability to the apparatus when it is rested upright on a horizontal surface.

Figure 3:
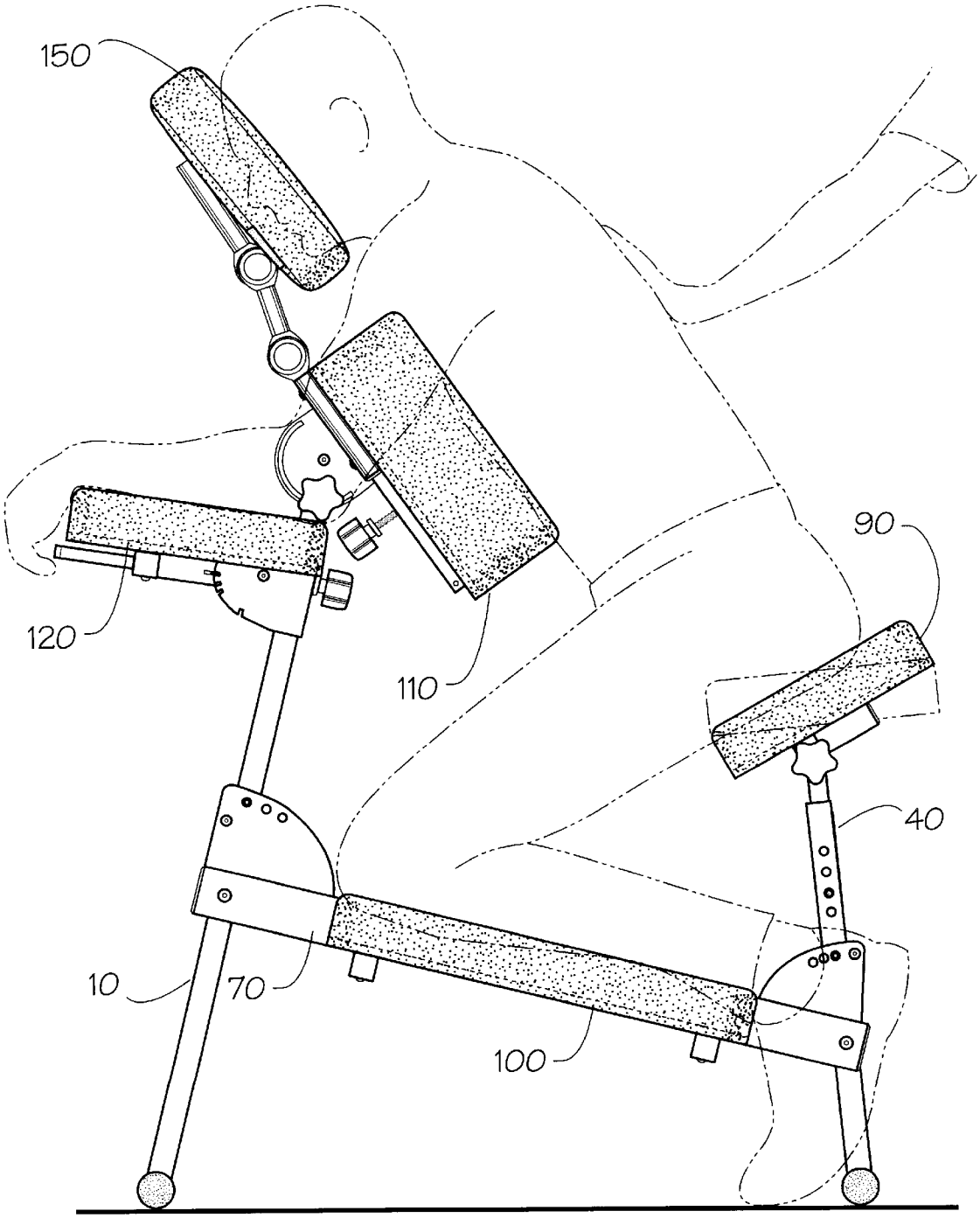
FIG. 3 is a side elevational view thereof showing the manner in which the invention receives an individual for massage, front and rear supports shown positioned in their most upright positions respectively.
Figure 4:
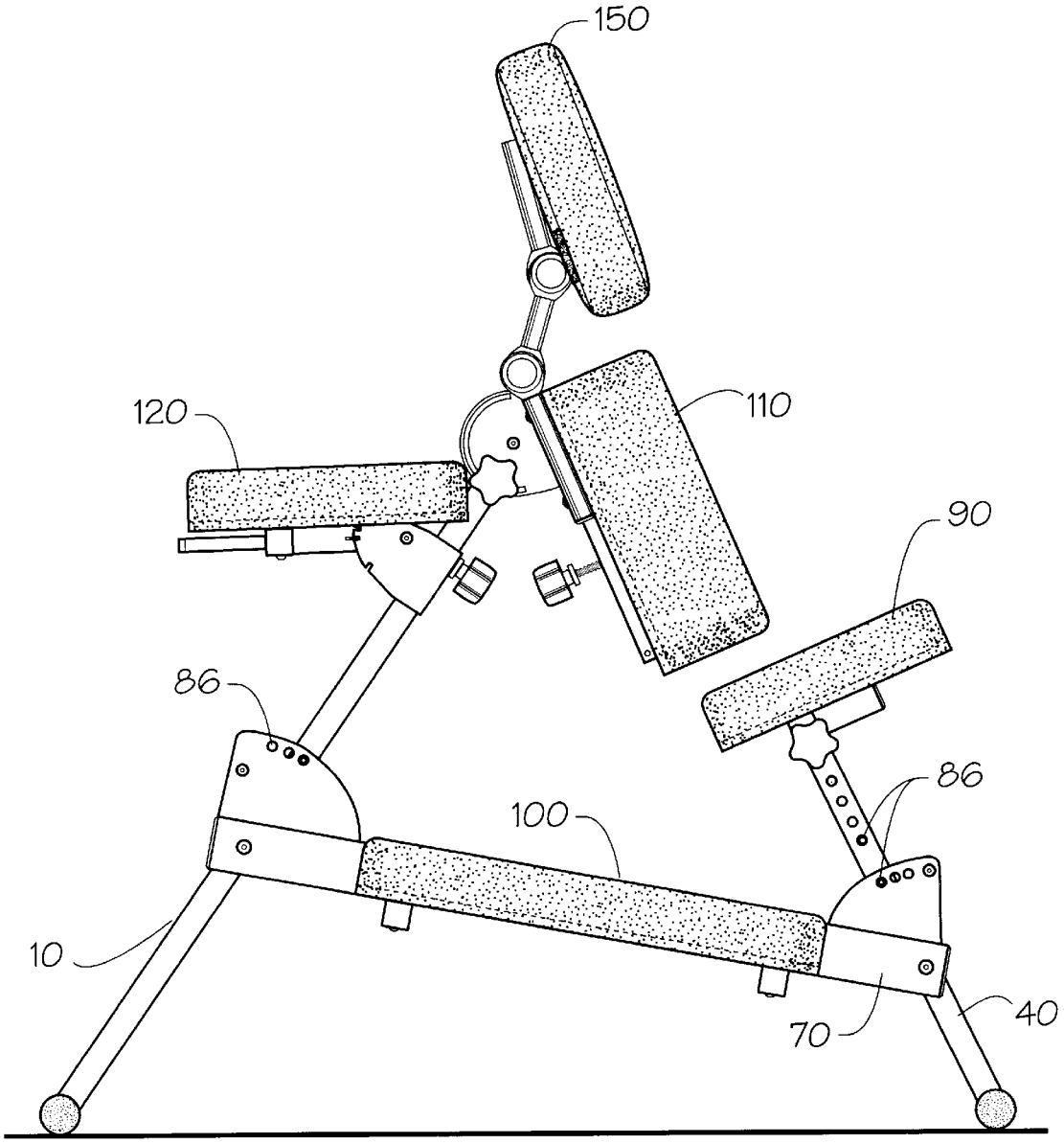
FIG. 4 is a side elevational view thereof, front and rear supports shown positioned in their most mutually convergent positions respectively for receiving a small adult or adolescent.

A leg rest strut means 70 is oriented in a near horizontal attitude and extends between the forward 10 and rearward 40 support struts and is pivotally engaged therewith at pivot rods 72, enabling the upward attitude of the forward and rearward support struts 10, 40 to be changed (see motion arrows "a" and "b" in FIG. 2*a*) over a range of upwardly convergent angles (between struts 10 and 40}, from approximately 22 angular degrees, as shown in FIG. 3 as a minimum, to approximately 69 angular degrees, as shown in FIG. 4 as a maximum for a total range of 47 angular degrees. The discovery of this range of angles is considered a important and novel in that this angular range defines the necessary range for accommodation of adult and child sized individuals in the apparatus, and has been discovered to result in limiting the necessary height and angular adjustment of the several support elements of the invention to ranges and types of motion that are both economical to achieve and which provide the necessary flexibility of accommodation. The forward support strut is adjustable between approximately 15 and 35 angular degrees with respect to vertical, and the rearward support strut is adjustable between approximately 7 and 34 angular degrees with respect to vertical. Thus it is seen that accommodation of a full sized adult (FIG. 3) as well as a small person or child (FIG. 4) is possible with the present apparatus. It should be clear that the adjustment of the support struts 10, 40 effectively diminish and enlarge the entire apparatus in a fundamental manner. It should be noted at this point, that such control over the basic size of such a massage chair has not been discovered prior to this so that the present invention is an essentially novel apparatus within the field of its art.

A strut locking means 80 fixes the forward and rearward support struts 10, 40 at a selected angle within the range of upwardly convergent angles previously noted. Locking means 80 preferably provides a pair of spaced apart and opposing plates 82 with a series of pairs of positioning holes 84. Plates 82 are preferably integral with rest strut means 70 so that the support struts 10, 40 articulate between the plates 82. Support struts 10 and 40 provide spring loaded pins 86 which are positionable for mating with any one of the pairs of positioning holes 84 so that with the struts 10 and 40 placed in a desired angular attitude corresponding with one of the pairs of holes 84 (for each strut), the pins 86 engage the holes 84 for fixing the struts 10, 40 into place. Other means for adjustment locking might be used with the present adjustable elements to similar advantage.

A buttock rest means 90, preferably a resilient pad of foam or other soft material with a fabric covering, is engaged with the rearward strut 40, at an upper end 40U of the strut 40. The seat pad may be raised, as shown in FIG. 3, or lowered as shown in FIG. 4 to suit the needs of the individual. The preferred manner of engaging and adjusting the rest means 90 is by extension means 90E using telescopic action between a seat mounting tube 92 and the rearward support strut 40 as seen in FIG. 2*a* with the linear vertical adjustment shown by arrow "c." Locking is secured in the same manner as described for the support struts 10, 40. The buttock rest means 90 is also preferably adjustable as to attitude or angle using pivot adjustment means 90P via knob 94. Knob 94 tightens rest means 90 on the seat mounting tube 92 after it has been adjusted as to angle as shown and denoted by arrow "d" in FIG. 2*a*. FIGS. 2*a* and 3 illustrate the type and range of motion preferably enabled. The mechanical structure and operation is similar to that of a common bicycle seat.

A leg rest means 100, preferably a resilient pair of spaced apart pads, is engaged with the leg rest strut means 70 and is fixed in a position for accepting the individual's legs from knee to ankle. Preferably, leg rest strut means 70 forms an angle with the floor or supporting surface for the apparatus, so that the knee is held at a slightly higher level then the ankle. Proper positioning of the legs, on leg rest means 100, is attained by height adjustment of the buttock rest means 90.

Figure 5:
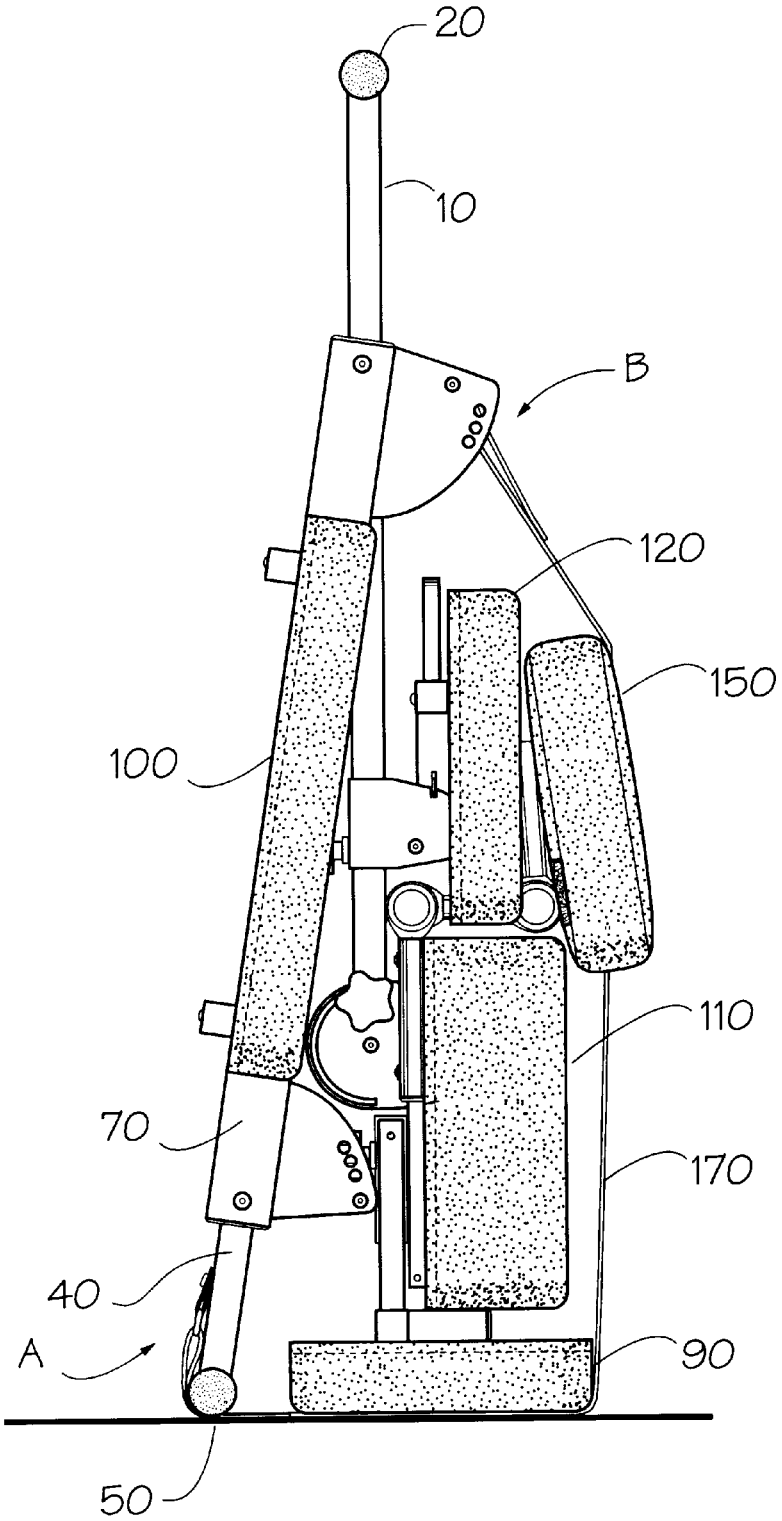
FIG. 5 is a side elevational view thereof, showing the manner in which the invention is compactly folded for carrying and for storage.

A chest rest means 110, preferably a resilient pad, is engaged with the forward support strut 10 at an upper end 10U. The chest rest means 110 depends rearwardly in a position for resting the chest of the individual as shown in FIG. 3. A chest rest height adjustment means 112, as best shown in FIG. 2*a*, provides vertical adjustment of the chest rest means 110. In the preferred embodiment adjustment means 112 includes a base plate 114 fixed to a pair of spaced apart wing plates 116. The wing plates are pivotally mounted to the upper end 10U of the forward support strut 10 by pivot rod 118. The chest rest means 110 has a C-shaped channel 119 fixed to the rest means 110, this channel 119 is slidably engaged with the base plate 114 for linear vertical adjustment of the rest means 110. Knob 113 is threaded through base plate 114 so as to lock the rest means 110 at any vertical position desired. Angular adjustment of the rest means 110 is provided by a chest rest angular adjustment means 111 providing rotation about pivot rod 118. Means 111 includes wing plates 116 having circular slots 116S centered on rod 118 and locking knobs 115 for locking the rest means 110 at any angular position over a range of approximately 180 angular degrees. Linear position adjustment is illustrated by arrow "e" in FIG. 2*a*, and angular adjustment by arrow "f" in FIG. 2*a*. Thus necessary articulation of the chest rest means 110 is provided to accommodate trunk length size and position on the apparatus to afford comfort and proper support of the individual during massage. The chest rest means 110 is rotatable so as to be approximately parallel and adjacent to the strut 10 when the apparatus is folded as shown in FIG. 5.

An arm rest means 120, preferably a resilient pad, is engaged with the forward support strut 10 near the upper end 10U and depends forwardly in a position for resting the arms of the individual as shown in FIG. 3. An arm rest height adjustment means 130 provides linear position adjustment along the forward support strut 10 as illustrated by arrow "g" in FIG. 2*a*, and an arm rest angle adjustment means 140 for attitude adjustment as illustrated by arrow "h" in FIG. 2*a*, is provide for necessary articulation of the arm rest means 120 to accommodate arm length size and position for proper support of the individual during massage. Height adjustment means 130 includes slot 132 in support strut 10 and knob 134 having a screw slidably engaged with the slot 132 and threaded into bracket 136. Bracket 136 is therefore able to slide along strut 10 and be tightened at a selected position of armrest means 120 by knob 134. Bracket 136 provides several slots 138S, comprising slot pairs on opposite sides of bracket 136, for engagement by tongs 138T (one on each side) which are moved, or actuated, by pull handle 139. This handle 139, is spring loaded (with the spring hidden from view) to urge tongs 138T into opposing slots 138S for locking the armrest means 120 at a selected angle. The arm rest means 120 is rotatable so as to be approximately parallel and adjacent to the strut 10 when the apparatus is folded as shown in FIG. 5.

A face rest means 150, preferably a resilient pad being split as shown in FIG. 1 for accepting a face, is engaged with the chest rest means 120 and extends in a generally upward direction therefrom in a position for resting the face of the individual, as shown in FIG. 3. The face rest means 150 is preferably mounted on an articulating adjustable strut means 160 as best seen in FIG. 1. In the preferred embodiment, the articulated strut means 160 includes a means for angular rotation 162 of the rest means 150 so as to accomplish rotation shown by letter "j" in FIG. 2*a*, and a means for relative positioning 164 of the face rest means 150 with respect to the chest rest means 110 as shown by letter "i" in FIG. 2*a*. Motions "i" and "j" are accomplished through the use of couple-joints which, are well known in the art. These joints are able to readily position the rods attached to them in any one of a plurality of set angular positions. Therefore, the face rest means 150 may be adjusted proximally and angularly with respect to the chest rest means 110 as shown in FIGS. 3 and 4, and folded as shown in FIG. 5.

The face 150, chest 110, arm 120, leg 100 and buttock 90 rest means are positioned in mutually cooperative positions for supporting the face, chest, arms, legs and buttock respectively of the individual in a semi-reposed attitude for receiving massage therapy. However, it is the specific adjustability of each of the rest means with respect to each of the others that provides novelty in the present invention.

The buttock support means 90 is removable from the rearward support strut 40 enabling this strut to be folded within the leg rest strut means 70 the support means 90 then being engagable with the chest support means as shown in FIG. 5 for more compactly storing the apparatus. Therefore, the rearward support strut 40 is foldable into colinear alignment with the leg support strut 70, the forward support strut 10 is foldable into near colinear alignment with the leg support strut 70 placing the arm support means 120 and the chest support means 110 in near parallel alignment with the leg support means 70 for compactly folding the apparatus. A strap 170 may be wrapped about the apparatus from point "A" to point "B" in order to maintain the apparatus in a compact folded arrangement as shown.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A chair apparatus for massaging an individual, the apparatus comprising:

a forward support strut having an upright attitude and providing a laterally disposed forward support means engaged at a lower end of the forward support strut, for lateral stability thereof, the forward support strut defining a forward end of the apparatus;

a rearward support strut having an upright attitude and providing a laterally disposed rearward support means engaged at a lower end of the rearward support strut, for lateral stability thereof, the rearward support strut defining a rearward end of the apparatus;

a leg rest strut means having a generally horizontal attitude and extending between the forward and rearward support struts and separately pivotally engaged with both the forward support strut and the rearward support strut, enabling the attitude of the forward and rearward support struts to be independently changed over a range of upwardly and mutually convergent angles;

a strut locking means fixing the forward and rearward support struts at a selected one of the range of upwardly convergent angles;

a buttock rest means engaged with the rearward support strut, at an upper end thereof;

a chest rest means engaged with the forward support strut, at an upper end thereof, the chest rest means depending rearwardly therefrom;

an arm rest means engaged with the forward support strut, at the upper end thereof, the arm rest means depending forwardly therefrom;

a face rest means engaged with the chest rest means and extending upwardly therefrom;

the face rest means, chest rest means, arm rest means, and buttock rest means being moveable in mutually cooperative positions for supporting the face, chest, arms, legs and buttock of the individual in a semi-reposed attitude for receiving massage therapy.

2. The apparatus of claim 1 wherein the rearward support strut provides extension means for raising and lowering the buttock support means, and buttock support means pivot adjustment means for attitude adjustment of the buttock support means.

3. The apparatus of claim 1 wherein the forward support strut provides arm rest height adjustment means for linear position adjustment of the arm rest means thereon, and arm rest angular adjustment means for attitude adjustment of the arm rest means.

4. The apparatus of claim 1 wherein the forward support strut provides chest rest angular adjustment means for attitude adjustment of the chest rest means.

5. The apparatus of claim 1 wherein the face rest means is interconnected with the chest rest means by an adjustable strut means enabling the face rest means to be adjusted proximally and angularly with respect to the chest rest means.

6. The apparatus of claim 1 wherein the range of upwardly convergent angles of the forward and rearward support struts is approximately 47 angular degrees.

7. The apparatus of claim 1 wherein the upwardly convergent angle between the forward and rearward support struts is from approximately 22 angular degrees to approximately 69 angular degrees.

8. The apparatus of claim 1 wherein the forward support strut is adjustable between approximately 15 and 35 angular degrees with respect to vertical, and the rearward support strut is adjustable between approximately 7 and 34 angular degrees with respect to vertical.

9. The apparatus of claim 1 wherein the rearward support strut, forward support strut and leg rest strut means are foldable into near colinear alignment.

10. The apparatus of claim 1 wherein the buttock rest means is removable from the rearward support strut and fixedly positionable between the chest rest means and the rearward support strut, the rearward support strut being foldable into colinear alignment with the leg rest strut means, the forward support strut being foldable into near colinear alignment with the leg rest strut means and the rearward support strut placing the arm rest means and the chest rest means in near parallel alignment with the leg rest strut means for compactly folding the apparatus, the buttock rest means being fixedly positionable for standing the apparatus thereupon in an upright attitude.

* * * * *